US005552266A

United States Patent [19]

Stanley et al.

[11] Patent Number: 5,552,266

[45] Date of Patent: Sep. 3, 1996

[54] PHOTOGRAPHIC MATERIAL COMPRISING A MAGENTA DYE IMAGE FORMING COUPLER COMBINATION

[75] Inventors: Paul L. R. Stanley; Christina M. Watts, both of Harrow, England

[73] Assignee: Eastman Kodak Company, Rochester, N.Y.

[21] Appl. No.: 946,310

[22] Filed: Oct. 30, 1992

[30] Foreign Application Priority Data

May 16, 1990 [GB] United Kingdom ..... 9010966

[51] Int. Cl.[6] ..... G03C 1/08; G03C 7/26; G03C 7/32

[52] U.S. Cl. ..... 430/546; 430/554; 430/555

[58] Field of Search ..... 430/551, 372, 430/546, 386, 387, 554, 555

[56] References Cited

U.S. PATENT DOCUMENTS

| | | | |
|---|---|---|---|
| 4,548,899 | 10/1985 | Nakayama et al. | 430/558 |
| 4,562,146 | 12/1985 | Masuda et al. | 430/546 |
| 4,581,326 | 4/1986 | Katoh et al. | 430/551 |
| 4,853,319 | 8/1989 | Krishnamurthy et al. | 430/387 |
| 4,942,116 | 7/1990 | Renner | 430/551 |
| 4,965,179 | 10/1990 | Kuwashima et al. | 430/546 |
| 5,126,234 | 6/1992 | Naruse et al. | 430/387 |
| 5,376,519 | 12/1994 | Merkel et al. | 430/546 |

FOREIGN PATENT DOCUMENTS

| | | |
|---|---|---|
| 0176845 | 4/1986 | European Pat. Off. . |
| 0257451 | 3/1988 | European Pat. Off. . |
| 0320776 | 6/1989 | European Pat. Off. . |
| 0137722 | 11/1989 | European Pat. Off. . |
| 0348135 | 12/1989 | European Pat. Off. . |
| 53-70822 | 6/1978 | Japan . |
| 59-204041 | 11/1984 | Japan . |
| 62-247368 | 10/1987 | Japan . |
| 2036068 | 7/1980 | United Kingdom . |

*Primary Examiner*—Geraldine Letscher
*Attorney, Agent, or Firm*—Paul A. Leipold

[57] ABSTRACT

The combination of a magenta dye image-forming coupler, such as a phenylpyrazolone, with a substituted phenol in a photographic material provides an enhancement in the light stability of the resultant magenta image dye.

The phenol has the formula (I):

(I)

wherein each R is the same or different and is an unsubstituted or substituted alkyl, halogen, cyano, $SO_2R^1$, $SO_2NHR^1$, $NHSO_2R^1$ or $COOR^1$ group, in which $R^1$ is an unsubstituted or substituted alkyl or aryl group and n is from 1 to 5.

The phenol may totally or partially replace the conventional coupler solvent. The combination is useful in single colour or multi-colour photographic silver halide emulsion materials and processes.

15 Claims, No Drawings

PHOTOGRAPHIC MATERIAL COMPRISING A MAGENTA DYE IMAGE FORMING COUPLER COMBINATION

This invention relates to a colour photographic silver halide material, in particular an improved photographic material containing a magenta dye image-forming coupler combination.

Colour photographic materials generally contain silver halide emulsion layers sensitised to each of the blue, green and red regions of the visible spectrum, with each layer having associated therewith a colour forming compound which, respectively yields a yellow, magenta or cyan dye.

Magenta dye image-forming couplers are usually employed to provide desired magenta dye images. A problem encountered with such couplers is one of poor light stability of the resultant magenta dye and attempts to overcome this have been focussed mainly on alterations of the structures of the coupler compounds, a time-consuming process.

There has been some documentation on the use of certain coupler solvents to improve the quality of the photographic image produced. Thus Japanese Patent Publication No. 59(1984)-204041 describes the use of urea compounds with cyan dye image-forming couplers to improve light fastness.

European Patent Application No. 137722 discloses the combination of pyrazolotriazole magenta couplers with phenolic compounds to improve resistance to formaldehyde and give good resistance to change of hue.

However nowhere is there any teaching or suggestion that the combination of a magenta coupler together with a substituted phenol would provide greatly enhanced light stability of the resultant magenta image dye with no deterioration in sensitometry. Colour photographic materials of vastly improved light stability have been found thereby to result using magenta couplers of proven good photographic performance. Furthermore some magenta couplers with light stability hitherto regarded as unacceptable can now be rendered useful when incorporated in photographic materials using these phenolic compounds.

According to the present invention there is provided the use of a substituted phenol in combination with a magenta dye image-forming coupler capable of forming a dye by reaction with oxidised colour developing agent, in a photographic material comprising a support having associated therewith a light-sensitive silver halide emulsion layer containing said combination, to provide an image of enhanced light stability, said phenol having the structural formula:

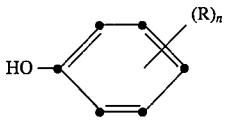

(I)

wherein each R is the same or different and is an unsubstituted or substituted alkyl, halogen, cyano, $SO_2R^1$, $SO_2NHR^1$, $NHSO_2R^1$ or $COOR^1$ group, in which $R^1$ is an unsubstituted or substituted alkyl or aryl group and n is from 1 to 5.

R or $R^1$ can be represented by alkyl groups having from 1 to about 20 carbon atoms, preferably from 1 to about 12 carbon atoms, which groups can be straight or branched chain and optionally substituted. Aryl groups which can be represented by $R^1$ have from about 6 to about 12 carbon atoms, the groups being optionally substituted, for example with one or more substituted or unsubstituted alkyl, hydroxy, alkoxy or aryloxy groups.

For the practice of the invention those phenols with the following structures are especially preferred:

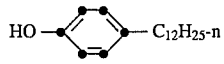

Phenol (1)

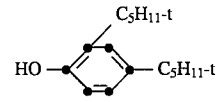

Phenol (2)

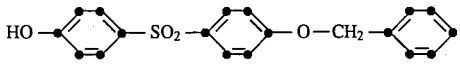

Phenol (3)

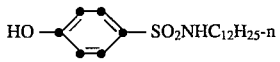

Phenol (4)

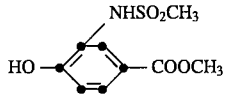

Phenol (5)

In a preferred embodiment of the invention the magenta colour couplers are pyrazolones of formula:

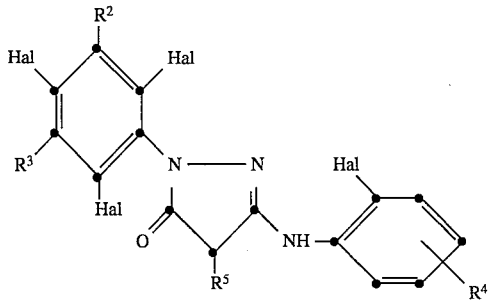

(II)

wherein Hal represents a halogen, $R^2$ and $R^3$ are the same or different and each is hydrogen or a halogen, $R^4$ is hydrogen, $COOR^{11}$, $CONHR^{11}$, $NHCOR^{11}$, $NHSO_2R^{11}$, $SO_2NHR^{11}$, $SO_2NR^{11}R^{12}$, $OSO_2R^{11}$, $SO_2R^{11}$ or $OR^{11}$;

$R^5$ is hydrogen or

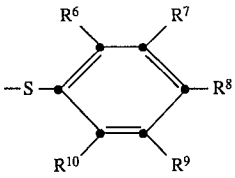

and $R^6$ is $NHSO_2R^{11}$, $NHCOR^{12}$, $NHCONHR^{12}$, $CONHR^{12}$, $NR^{11}R^{12}$, $R^{11}$, $OR^{11}$;

$R^7$, $R^8$, $R^9$ and $R^{10}$ are the same or different and each is hydrogen, a halogen or $R^6$;

$R^{11}$ and $R^{12}$ are the same or different and each is an unsubstituted or substituted alkyl or $R^{12}$ may be hydrogen.

In another aspect of the invention there is provided a photographic material comprising a support, a silver halide emulsion layer and, associated therewith, a pyrazolone magenta dye image-forming coupler of formula (II) as hereinbefore defined which is capable of forming a dye by reaction with oxidised colour developing agent in combination with a substituted phenol of formula (I), as hereinbefore defined.

In a further aspect there is provided a multicolour photographic material comprising a support bearing yellow, magenta and cyan dye image-forming units comprising at least one blue-, green- or red-sensitive silver halide emulsion layer having associated therewith at least one yellow, magenta or cyan dye-forming coupler respectively, at least one of the magenta dye-forming couplers being a pyrazolone of formula (II) as hereinbefore defined in combination with a substituted phenol of formula (I), as hereinbefore defined.

Examples of groups which $R^{11}$ and $R^{12}$ may represent are methyl, ethyl, n-propyl, iso-propyl, n-butyl, t-butyl as well as pentyl, hexyl and octyl groups and higher alkyl groups having 10 to 20 carbon atoms. Such alkyl groups are often substituted, for example with halogen, alkoxy, hydroxy, carboxylic acid, aryl, or aryloxy, each of which may have further substitution.

Particularly preferred pyrazolone couplers of formula (II) are those wherein $R^4$ is an amide or ester linked ballast group, i.e. $R^4$ is $NHCOR^{11}$ or $COOR^{11}$ especially those wherein $R^{11}$ is a higher alkyl group, as defined above, for example $R^4$ is the group $COOC_{12}H_{25}$, or a higher alkyl group optionally substituted by a substituted phenol group, in particular the group

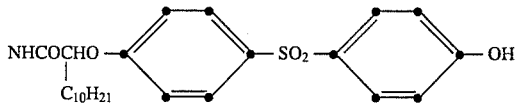

Moreover those couplers wherein $R^5$ is a hydrogen atom or a group

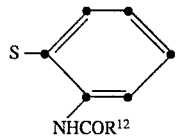

i.e. $R^6$ is $NHCOR^{12}$, preferably wherein $R^{12}$ is $C_4H_9$—t, are especially preferred.

The following table exemplifies typical coupler ballasts which may be used in the practice of the invention but these in no way are to be interpreted as limiting the scope of the invention.

TABLE 1

| Coupler Number | $R^2$ | $R^3$ | $R^4$ | $R^5$ |
|---|---|---|---|---|
| 1 | H | H | 3-NHCOCHO(C10H21)—C6H4—SO2—C6H4—OH | H |
| 2 | Cl | Cl | 4-$CO_2C_{12}H_{25}$ | S—C6H4—NHCOC4H9(t) |
| 3 | H | H | 3-NHCOCHO(C10H21)—C6H4—SO2—C6H4—OH | S—C6H4—C4H9-(t) |
| 4 | H | H | 3-NHCOCHO(C10H21)—C6H4—SO2—C6H4—OH | S—C6H3(CH3)—NHCOCH3 |
| 5 | H | H | 3-NHCOCHO(C10H21)—C6H4—SO2—C6H4—OH | S—C6H4—NHSO2CH3 |
| 6 | H | H | 3-NHCOCHO(C10H21)—C6H4—SO2—C6H4—OH | S—C6H2(C3H7(i))2—C3H7(i) |
| 7 | Cl | Cl | 4-$CO_2C_{12}H_{25}$ | H |
| 8 | Cl | Cl | 4-$CO_2C_{12}H_{25}$ | S—C6H4—NHCONHC4H9(n) |
| 9 | Cl | Cl | 4-$CO_2C_{12}H_{25}$ | S—C6H4—C4H9(t)—Cl |

TABLE 1-continued
| Coupler Number | $R^2$ | $R^3$ | $R^4$ | $R^5$ |
|---|---|---|---|---|
| 10 | Cl | Cl | 4-$CO_2C_{12}H_{25}$ | 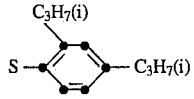 |
| 11 | Cl | Cl | 4-$CO_2C_{12}H_{25}$ | 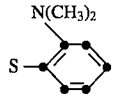 |
| 12 | Cl | Cl | 4-$CO_2C_{12}H_{25}$ | 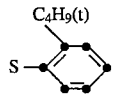 |
| 13 | H | H | 3-$CO_2C_{12}H_{25}$ | 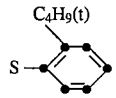 |
| 14 | H | H | 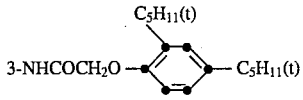 | H |
| 15 | H | H | 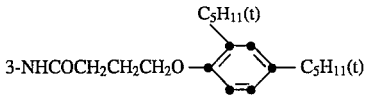 | 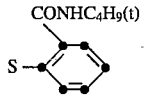 |
| 16 | H | H | 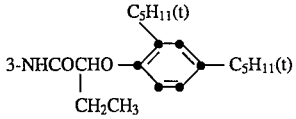 | H |
| 17 | H | H | 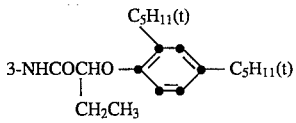 | 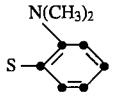 |
| 18 | H | H | 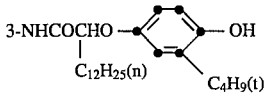 | H |
| 19 | H | H | 3-$NHCOC_{13}H_{27}$(n) | 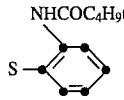 |
| 20 | H | H | 3-$NHSO_2C_{16}H_{33}$ | 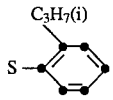 |
| 21 | H | H | 4-$SO_2NHC_{12}H_{25}$ | 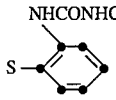 |
| 22 | Cl | Cl | 3-$SO_2N(CH_3)C_{18}H_{37}$ | H |
| 23 | H | H | 3-$OSO_2C_{16}H_{33}$ | H |
| 24 | Cl | Cl | 4-$SO_2C_{12}H_{25}$ | H |
| 25 | Cl | Cl | 3-$OC_{16}H_{33}$ | H |

The substituted phenols are generally commercially available or can be readily prepared from those by standard procedures known in the art.

Couplers which form magenta dye upon reaction with oxidised colour developing agents are described in such representative patents and publications as U.S. Pat. Nos. 1,969,479;; 2,311,082; 2,343,703; 2,369,489; 2,600,788; 2,908,573; 3,061,432; 3,062,653; 3,152,896; 3,519,429; 3,725,067; 4,443,536, European Patent Publication Nos. 170164 and 177765 and U.S. application Ser. Nos. 23,517 to 23,520, the disclosures of which are incorporated herein by reference.

The magenta coupler is dispersed in the substituted phenol in the ratio 1:0.1 to 1:5 parts by weight, preferably 1:0.3 to 1:1, most preferably 1:0.5, with, for example, aqueous gelatin, optionally containing a surfactant, as the continuous phase. In addition an auxiliary coupler solvent may be used, for example ethyl acetate, cyclohexanone or preferably 2-(2-butoxy-ethoxy) ethyl acetate, and this is generally present in an equal or greater proportion by weight than the phenol. Preferably a ratio of coupler/phenol/auxiliary coupler of 1:0.5:1.5 has been found to be advantageous.

Generally, the most favourable light stability enhancement is normally obtained with the total replacement of the conventional coupler solvent, tricresyl phosphate, by a substituted phenol, as shown in Table 2. However a surprisingly marked improvement is also observed if only a proportion, even 25%, of the tricresyl phosphate is replaced, as can be seen from Table 3, and in certain coupler/phenol combinations this may be advantageous on solubility and viscosity grounds.

The resulting dispersion is then associated with a silver halide emulsion layer coated on a support to form a photographic element. As used herein, the term "associated with" signifies that the coupler is incorporated in the silver halide emulsion layer or in a layer adjacent thereto where, during processing, it is capable of reacting with silver halide development products.

The photographic elements can be single colour elements or multicolour elements. In a multicolour element, the magenta dye-forming coupler combinations of this invention would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively. According to the present invention at least one of these magenta dye-forming couplers would be in combination with a substituted phenol. The element can contain additional layers, such as filter and barrier layers.

In the following discussion of suitable materials for use in the emulsions and elements of this invention, reference will be made to Research Disclosure, December 1989, Item 308119, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the pyrazolone coupler combinations of this invention, the elements of the invention can include additional couplers as described in Research Disclosure Section VII, paragraphs D, E, F and G and the publications cited therein. The coupler combinations of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardeners (see Research Disclosure Section X), plasticisers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidise the colour developing agent. Oxidised colour developing agent in turn reacts with the coupler to yield a dye.

Preferred colour developing agents are p-phenylene diamines. Especially preferred are 4-amino-3-methyl-N,N-diethylaniline hydrochloride, 4-amino-3-methyl-N-ethyl-N-β-(methanesulphonamido)ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride and 4-amino-N-ethyl-N-(2-methoxyethyl)-m-toluidine di-p-toluene sulphonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following Examples are given for a better understanding of the invention. All temperatures are in °C.

Example 1 Light Stability Advantage

Coatings of the following format were made, coating weights being in $gm^{-2}$:

| | |
|---|---|
| Gelatin supercoat | (1.5) |
| Green sensitised silver bromoiodide emulsion | (1.61) |
| Coupler | (1.04 mmol/$m^2$) |
| Gelatin | (2.42) |
| Bis methylvinyl sulphone (hardener) | (0.06) |
| Cellulose Acetate Support | |

A dispersion was made of the selected coupler in a mixture of either (1) tricresyl phosphate as control or (2) a substituted phenol or (3) a combination of tricresyl phosphate/substituted phenol, together with 2-(2-butoxyethoxy) ethyl acetate as auxiliary solvent in a ratio of 1:0.5:1.5 by weight with gelatin as the continuous phase, such that the resultant dispersion contained 8.8% coupler and 6% gelatin by weight.

The strips were sensitometrically exposed with ultraviolet and -blue filters for 0.1 sec and processed through the commercially available process.

Combinations of couplers/substituted phenols of the invention were compared with similar combinations of couplers/tricresyl phosphate and tricresyl phosphate/substituted phenol combinations with regard to the light stability of the dye produced when processed in a C-41 process, and the results shown in Tables 2 and 3 respectively.

Dye samples of about 1.0 optical density were prepared by giving the above coatings the appropriate exposure and processing through a C-41 process. In each case the visible absorption spectrum of the dye sample was measured using a Pye-Unicam SP8-100 Spectrophotometer and the density of maximum absorption obtained from the spectrum. The dye samples were subjected to 100 hrs and 200 hrs cumulative lade using a fadeometer. In this process the dye samples were fixed at a distance of 10 cm (4") from a fadeometer light source consisting of 2 pairs of 1.8 m (6 ft) 75–85 watt fluorescent tubes, with an illuminance value of 18.8 klux, in a temperature and humidity controlled room at a constant 20° C./50% relative humidity.

After each fade period the absorption spectrum was remeasured and the dye light fade expressed as:

$$\text{fade} = -\left[\frac{D_{init.} - D_{fade}}{D_{init.}}\right] \quad \text{where } D_{init.} = \text{initial density and } D_{fade} = \text{density after fading}$$

TABLE 2

| Combination | Light Fade (200 hr) |
|---|---|
| Coupler (1) + tricresyl phosphate | −0.37 |
| Coupler (1) + Phenol (1) | −0.20 |
| Coupler (1) + Phenol (2) | −0.12 |
| Coupler (1) + Phenol (3) | −0.22 |
| Coupler (1) + Phenol (4) | −0.26 |
| Coupler (1) + Phenol (5) | −0.26 |
| Coupler (2) + tricresyl phosphate | −0.42 |
| Coupler (2) + Phenol (1) | −0.21 |
| Coupler (2) + Phenol (2) | −0.06 |

TABLE 3

| Combination | | Light Fade (200 hr) |
|---|---|---|
| Coupler (2) + 100% | tricresyl phosphate | −0.42 |
| Coupler (2) + 75% 25% | tricresyl phosphate/ Phenol (1) | −0.30 |
| Coupler (2) + 50% 50% | tricresyl phosphate/ Phenol (1) | −0.29 |
| Coupler (2) + 25% 75% | tricresyl phosphate/ Phenol (1) | −0.23 |
| Coupler (2) + 100% | Phenol (1) | −0.21 |
| Coupler (2) + 100% | tricresyl phosphate | −0.42 |
| Coupler (2) + 75% 25% | tricresyl phosphate/ Phenol (2) | −0.16 |
| Coupler (2) + 50% 50% | tricresyl phosphate/ Phenol (2) | −0.11 |
| Coupler (2) + 25% 75% | tricresyl phosphate/ Phenol (2) | −0.08 |
| Coupler (2) + 100% | Phenol (2) | −0.06 |

Table 2 shows that the couplers when combined with a substituted phenol have a greatly enhanced light stability when compared with the couplers in the normal tricresyl phosphate formulations. Moreover it can be seen from Table 3 that even partial replacement of the tricresyl phosphate by a substituted phenol can give a very significant improvement in light stability.

We claim:

1. A photographic element comprising a support bearing a light-sensitive silver halide emulsion and, in association with said support and said silver halide emulsion to provide an image of enhanced light stability, at least one layer comprising a dispersion of a substituted phenol, a magenta dye image-forming coupler capable of forming a magenta dye by reaction with oxidized color developing agent, and a light-sensitive silver halide emulsion, characterized in that said phenol has the structural formula

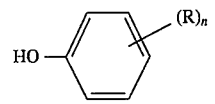

(I)

wherein each R is the same or different and is an alkyl, halogen, cyano, $SO_2R^1$, $SO_2NHR^1$, wherein $R^1$ is an alkyl or aryl group and n is from 1 to 5, provided that when R is an alkyl group, the total number of carbon atoms in $(R)_n$ is less than 20, and said magenta coupler is a pyrazolone of formula

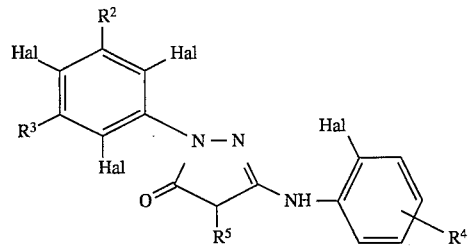

(II)

wherein

Hal represents a halogen, $R^2$ and $R^3$ are the same or different and each is hydrogen or a halogen, $R^4$ is hydrogen, $COOR^{11}$, $CONHR^{11}$, $NHCOR^{11}$, $NHSO_2R^{11}$, $SO_2NHR^{11}$, $SO_2NR^{11}R^{12}$, $OSO_2R^{11}$, $SO_2R^{11}$ or $OR^{11}$;

$R^5$ is hydrogen or

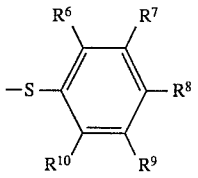

and $R^6$ is $NHSO_2R^{11}$, $NHCOR^{12}$, $NHCONHR^{12}$, $CONHR^{12}$, $NR^{11}R^{12}$, $R^{11}$, $OR^{11}$;

$R^7$, $R^8$, $R^9$ and $R^{10}$ are the same or different and each is hydrogen, a halogen or $R^6$;

$R^{11}$ and $R^{12}$ are the same or different and each is an alkyl; halogen, alkoxy, hydroxy, carboxylic acid, aryl, or aryloxy substituted alkyl; or $R^{12}$ may be hydrogen.

2. The photographic element of claim 1 wherein R of Formula I is selected from the group consisting of 4-$C_{12}H_{25}$-n; 2-$C_5H_{11}$-t, 4-$C_5H_{11}$-t;

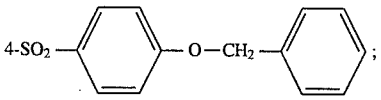

4-$SO_2NHC_{12}H_{25}$-n and 2-$N_{HSO2}CH_3$, 4-$COOCH_3$.

3. The photographic element of claim 1 wherein $R^4$ is an ester linked ballast group of formula $COOR^{11}$.

4. The photographic element of claim 1 wherein $R^4$ is the group $CO_2C_{12}H_{25}$.

5. The photographic element of claim 1 wherein $R^4$ is an amide linked ballast group of formula $NHCOR^{11}$.

6. The photographic element of claim 1 wherein $R^{11}$ is a higher alkyl group having 10 to 20 carbon atoms, and said higher alkyl group is substituted by a substituted phenol group.

7. The photographic element of claim 1 wherein $R^4$ is the group

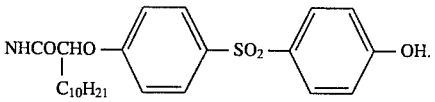

8. The photographic element of claim 1 wherein $R^5$ is hydrogen.

9. The photographic element of claim 1 wherein $R^5$ is the group

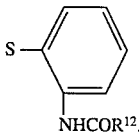

10. The photographic element of claim 1 wherein $R^5$ is the group

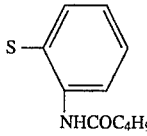

11. The photographic element of claim 1 wherein the magenta coupler is dispersed in the phenol in the ratio 1:0.1 to 1:5 parts by weight.

12. The photographic element of claim 1 further comprising layers containing yellow dye forming couplers and cyan dye forming couplers.

13. The photographic element of claim 1 wherein the magenta coupler is dispersed in the phenol in the ratio 1:0.3 to 1:1 parts by weight.

14. The photographic element of claim 1 wherein the magenta coupler is dispersed in the phenol in the ratio 1:0.5 parts by weight.

15. A photographic element comprising a support bearing a light-sensitive silver halide emulsion and, in association with said support and said silver halide emulsion to provide an image of enhanced light stability, at least one layer comprising a dispersion of a substituted phenol, a magenta dye image-forming coupler capable of forming a magenta dye by reaction with oxidized color developing agent, and a light-sensitive silver halide emulsion, characterized in that said phenol is selected from the group consisting of

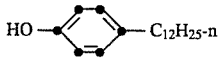

Phenol (1)

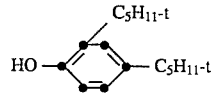

Phenol (2)

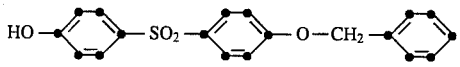

Phenol (3)

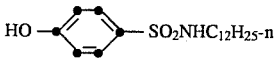

Phenol (4)

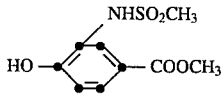

Phenol (5)

and said magenta coupler is a pyrazolone of formula

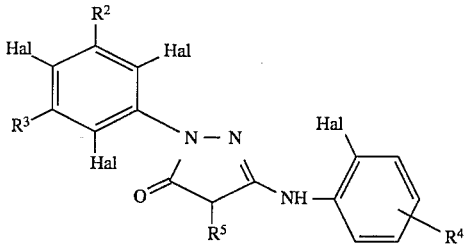

(II)

wherein

Hal represents a halogen, $R^2$ and R3 are the same or different and each is hydrogen or a halogen, $R^4$ is hydrogen, $COOR^{11}$, $CONHR^{11}$, $NHCOR^{11}$, $NHSO_2R^{11}$, $SO_2NHR^{11}$, $SO_2NR^{11}R^{12}$, $OSO_2R^{11}$, $SO_2R^{11}$ or $OR^{11}$;

$R^5$ is hydrogen or

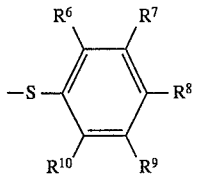

and $R^6$ is $NHSO_2R^{11}$, $NHCOR^{12}$, $NHCONHR^{12}$, $CONHR^{12}$, $NR^{11}R^{12}$, $R^{11}$, $OR^{11}$;

$R^7$, $R^8$, $R^9$ and $R^{10}$ are the same or different and each is hydrogen, a halogen or $R^6$;

$R^{11}$ and $R^{12}$ are the same or different and each is an alkyl; halogen, alkoxy, hydroxy, carboxylic acid, aryl, or aryloxy substituted alkyl; or $R^{12}$ may be hydrogen.

* * * * *